United States Patent [19]

Sieroslawski et al.

[11] Patent Number: 4,907,318

[45] Date of Patent: Mar. 13, 1990

[54] SLIVER CONTROL DRAFTING CRADLE

[76] Inventors: Donald L. Sieroslawski, Rte. 7, Box 209, Piedmont, S.C. 29673; Luther W. Cranford, 1038 E. Perry Rd., Greenville, S.C. 29609

[21] Appl. No.: 238,192

[22] Filed: Aug. 30, 1988

[51] Int. Cl.[4] ..... D01H 5/86; D01H 5/88

[52] U.S. Cl. ..... 19/255

[58] Field of Search ..... 19/244, 245, 246, 247, 19/254, 255

[56] References Cited

U.S. PATENT DOCUMENTS

| | | | |
|---|---|---|---|
| 2,402,356 | 6/1946 | Bacon et al. | 19/244 |
| 3,618,172 | 11/1971 | Crenshaw | 19/245 |
| 4,274,179 | 6/1981 | Swanson | 19/245 |

FOREIGN PATENT DOCUMENTS

| | | | |
|---|---|---|---|
| 8603793 | 7/1986 | World Int. Prop. O. | 19/244 |

*Primary Examiner*—Werner H. Schroeder
*Assistant Examiner*—D. Price
*Attorney, Agent, or Firm*—Cort Flint

[57] ABSTRACT

An apron drafting system (A) is disclosed which includes upper and lower drafting aprons (10, 12) between which a sliver (S) is delivered. An upper fiber control plate (20) and a lower fiber control plate (22) contain the fiber contacting apron runs (10*a*, 12*a*) in fiber contacting relation by preventing loss of fiber control, particularly in the case of large fiber tuft deliveries. Opposing concave surfaces (20*a*, 22*a*) contain the inward deflections of the apron within a prescribed fiber control range. Preferably, side plates (30, 32) of the drafting system are transparent to provide a window through which fiber delivery may be detected. A sliver guide (52) is mounted on a removable shelf (50) so that accumulation of sliver between a nip (56) of top and bottom apron rolls (14, 18) does not break the sliver guide but pushes it rearward for disengagement.

21 Claims, 3 Drawing Sheets

SLIVER CONTROL DRAFTING CRADLE

BACKGROUND OF THE INVENTION

The present invention relates generally to apron drafting systems for textile fibers, and more particularly to an apron drafting cradle having improved sliver control and maintenance features for detecting drafting irregularities. Three roll drafting systems are typically used in spinning and roving frames. The three roll system includes three pairs of upper and lower roll sets at spaced intervals. The sliver is fed initially to the back rolls, then to a set of middle rolls, and then to a set of front rolls from which the drafted sliver passes to a bobbin on which the sliver are roving is wound. Each of the sets of rolls is driven successively at a faster speed than the previous set which constitutes a draft ratio between the sets of rolls. The speed ratio between the middle set of rolls and the back rolls defines the back draft ratio and the speed ratio between the front set of rolls and the middle set of rolls is the front draft ratio. In each set of rolls, the top roll is freely rotatable and is driven by the bottom roll.

In order to exercise better control over the fibers in the front drafting zone, it has been typical to provide a drafting apron device having flat rubber aprons between which the fibers are drafted. The upper apron travels about the top roll and the lower apron travels about the bottom roll. The middle drafting apron may be one of two types. First there is the split cradle design in which the structures for mounting the aprons are separate and the other is a one-piece drafting apron cradle in which the upper and lower aprons and rolls are mounted on a single cradle. Examples of the one-piece apron drafting cradle are shown in U.S. Pat. Nos. 4,274,179 and 3,872,546. The desirability of exerting positive control over the fibers during drafting are known as discussed in U.S. Pat. Nos. 4,727,626 and 4,391,021. U.S. Pat. No. 4,727,626 is concerned with adjusting the nip points of a drafting zone to compensate for different fiber lengths in the sliver being drafted. In this manner, effective control may be had for different types of fibers to avoid fiber breakage and other drafting problems. U.S. Pat. No. 4,391,021 seeks to provide better fiber control in the back drafting zone. In the conventional one-piece cradle design, the upper and lower aprons pass over guide pins before returning to the respective top and bottom rolls which are rotating. Generally, the guide pin is arranged as close as possible to the nip of the front set of drafting rolls so the fibers can be guided a maximum distance between the two aprons in the front drafting zone. U.S. Pat. No. 4,391,021 proposes to place guide pins at the front and the back of the aprons while moving the top and bottom rolls towards the center of the assembly. However, fibers may still gather excessively between the belts causing the belts to separate and lose control over the sliver between the apron pins at the ends of the aprons. In addition, platforms may be inserted beneath the lower apron so that a generally S-shaped deflection may be imparted to the fibers which is said to increase control. In essence, the entire nip between the top and bottom rolls of the apron drafting system is taken up by the aprons leaving little, if any, room to accommodate variances in the thickness of sliver travelling between the rolls. This arrangement is said to provide a nip between the middle set of rolls toward both the nip of the back rolls and the front rolls to provide increased control over drafting in the back drafting zone.

The problem of maintaining the surfaces of the upper and lower aprons in contacting relationship in order to maintain control of the slivers drafted between the aprons remains to be a problem to which considerable attention needs to be given. Broken fibers and other fiber irregularities can build up between the upper and lower aprons causing the apron surfaces to, at least partially, lose contact resulting in loss of control over the slivers being drafted. Further, it has been difficult to detect the presence of fiber accumulation and other fiber irregularities occurring between the drafting aprons which is a critical area in the drafting process. Due to the obscurity of the location of the drafting apron assembly, particularly the one-piece cradle type used on a roll stand as shown in U.S. Pat. No. 3,872,546, it is difficult to observe malfunctioning.

Often, extraneous fibers can accumulate on the drafting aprons and be conveyed between the aprons causing fiber build-up and loss of sliver control. U.S. Pat. No. 4,274,179 proposes a clearer pad for maintaining the top apron clear of fibers. However, this device is mounted in a space consuming manner and may have only a limited biasing force against the apron to keep it clean. The attachment does not provide for mounting to the bottom for clearing the lower apron.

Accordingly, an object of the invention is to provide a one-piece drafting apron having increased sliver control between the drafting aprons.

Another object of the invention is to provide a drafting apron assembly having better control over the fibers between the drafting aprons.

Another object of the invention is to provide an apron drafting cradle having improved means for clearing extraneous fibers from the surfaces of the upper and lower aprons.

Another object of the invention is to provide a one-piece sliver drafting cradle in which inspection of the area between the drafting aprons may be had to detect the build-up of extraneous fibers and other fiber irregularities which adversely effect the drafting process

SUMMARY OF THE INVENTION

The above objectives are accomplished according to the invention by providing a mounting means which includes spaced side plates between which the upper and lower aprons are carried. A cradle shelf extends between the side plates which includes a one-piece sliver guide for guiding a sliver of fibers through the drafting aprons and a shelf attachment for releasably attaching the shelf and guide to the side plates so that the shelf automatically detaches from the side plates in the event sliver accumulates between a nip of the top and bottom roll and sliver guide. An apron drafting system comprises an integral apron drafting cradle which has a pair of spaced side plates. An upper drafting apron and a lower drafting apron are carried by the side plates. A top roll and an upper apron guide runs about which the upper apron travel, in respective first and second runs. A bottom roll and a lower apron guide run about the lower apron and travels in respective first and second runs. The first runs of the upper and lower aprons are arranged in a fiber transport relation for delivering the fibers between the aprons during drafting, and window means are formed by the side plates for visible inspection of the first runs of the upper and lower aprons, and detection of unwanted fiber accumulations between the upper and lower aprons between the side plates. A lower fiber control plate is interposed between the first and second runs of the lower apron, The lower fiber control plate is carried near the first run to limit the deflection of the first run in a direction generally normal to the first run. An upper fiber control plate is interposed between the first and second runs of the upper apron. The upper fiber control plate is carried near the first run to limit the deflection of the first run in a generally normal direction to the first run. Upper and lower fiber control plates include a fiber control groove extending through a width of the plates in the direction of sliver travel for controlling the deflection of the upper and lower aprons. The groove has a depth which allows the aprons to deflect within a prescribed range and which limits the deflection beyond the range. The upper and lower fiber control plates include apron contacting and guiding ledges formed on either side of the grooves for supporting and guiding marginal edges of upper and lower aprons as a medial portion of the aprons deflects into the grooves to maintain control over the sliver while accommodating passage of large tufts and the like.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
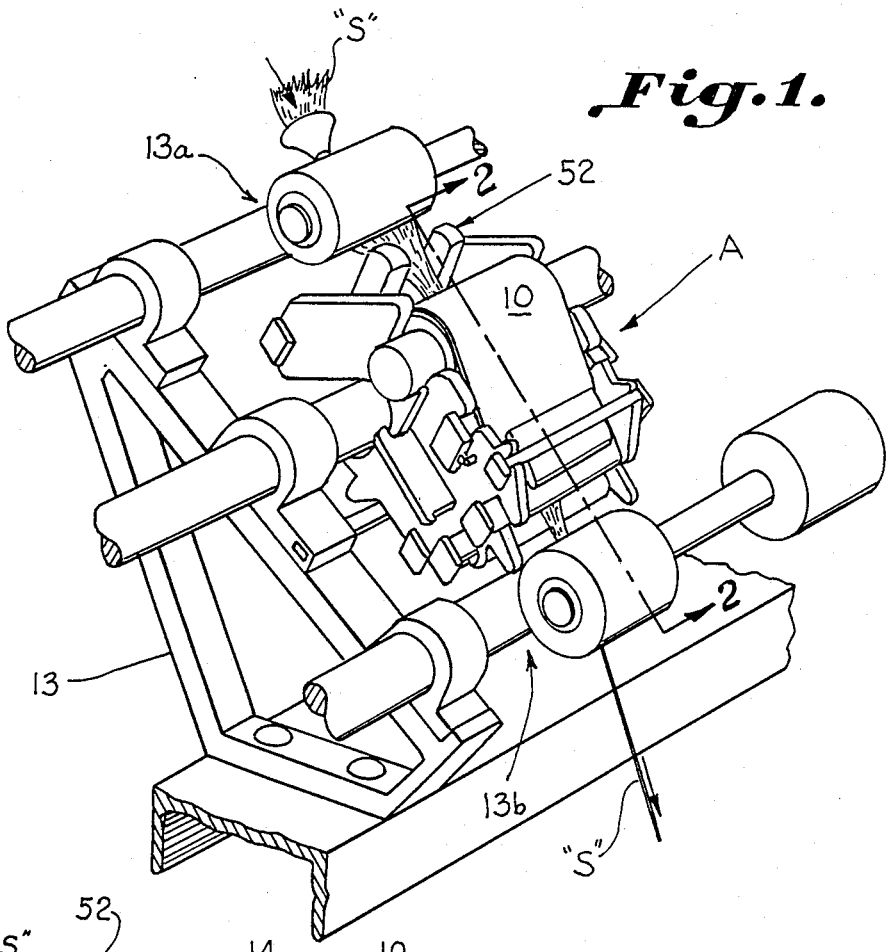
FIG. 1 is a perspective view of an improved drafting apron cradle constructed according to the invention.
Figure 2:
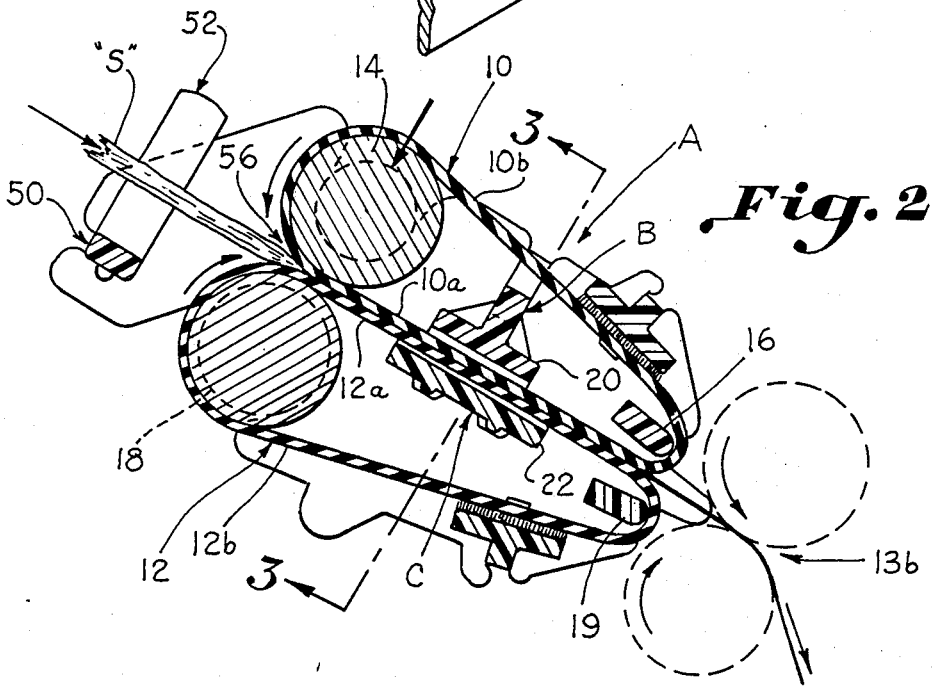
FIG. 2 is a sectional view taken along line 2—2 of FIG. 1.

Referring now in more detail to the drawings, an apron drafting system, designated generally as A, is illustrated for drafting textile fibers in the form of sliver and the like which comprises an upper apron 10 and a lower apron 12 between which sliver "S" is drafted. Mounting means is provided for mounting upper apron 10 generally above lower apron 12 and for rotating said upper and lower aprons to cause drafting of sliver in a first direction. Apron drafting system A is mounted on a roll stand 13 between a back set of drafting rolls 13*a* and a front set of drafting rolls 13*b*, as can best be seen in FIG. 1.

Upper apron 10 has a first run 10*a* and a second run 10*b* between a top roll 14 and a top apron guide 16 about which the upper apron travels. Lower apron 12 has a first run 12*a* and a second run 12*b* between a bottom roll 18 and a bottom apron guide 19 about which bottom apron 12 travels. First run 10*a* of the upper apron and first run 12*a* of the lower apron co-extend with each other in fiber delivery relation and generally in face to face contact.

Figure 3:
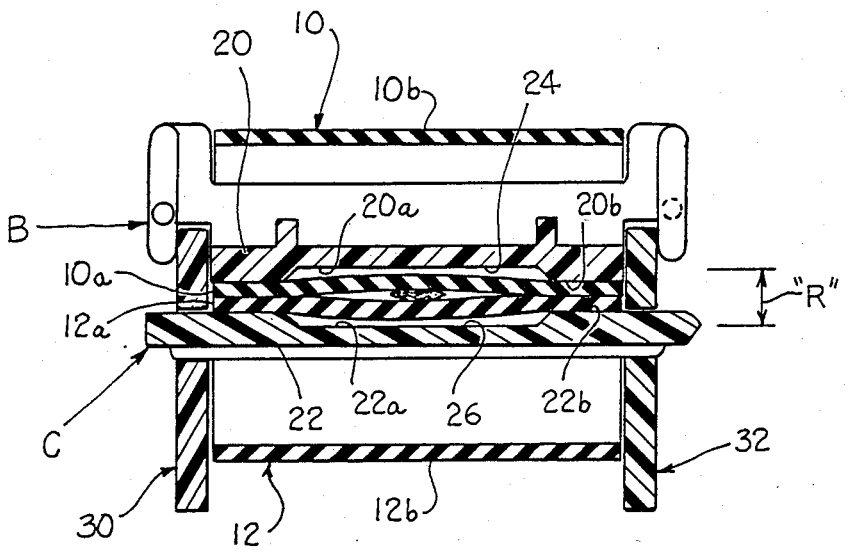
FIG. 3 is a sectional view taken along line 3—3 of FIG. 2.

Fiber control means B, C are disposed adjacent first run 10*a* of upper apron 10 and first run 12*a* of lower apron 12 for controlling deflection of aprons 10, 12 in a direction generally normal to the first runs. This allows apron deflection in a prescribed range and limits apron deflection beyond this range. As can best be seen in FIG. 3, fiber control means B includes an upper fiber control plate 20 carried near first run 10*a* of upper apron 10. Fiber control means C includes a lower fiber control plate 22 carried near first run 12*a* of lower apron 12. The upper and lower fiber control plates 20, 22 are arranged between the respective first and second runs 10*a*, 12*a* of the aprons immediately adjacent the respective first runs. The fiber control means includes an upper concave groove 20*a* formed in upper control plate 20 and a lower concave groove 22*a* formed in lower control plate 22. The grooves are concave in the sense that the surfaces defining the grooves are formed inwardly, and not necessarily that the surfaces are curved. The first runs 10*a*, 12*a* of the upper and lower aprons deflect into upper and lower concave grooves 20*a*, 22*a*, respectively. Upper and lower control plates 20, 22 include apron guide ledges 20*b*, 22*b* defined on opposing sides of upper and lower concave grooves 20*a*, 22*a* for guiding and supporting marginal edges of aprons 10, 12. Concave grooves 20*a*, 22*a* are formed generally centrally in the control plates to confine the sliver centrally of the aprons during delivery between the aprons. The control plates control the fibers all the way through the draft zone of the cradle, i.e. from rolls 14, 18 to guide pins 16, 19. The control plates act as cushions for the fibers and can be used with short and long staple. Both the upper and lower control plates also maintain the respective aprons in proper alignment for draft contact. When the fibers are being drafted, they stay in place instead of going from one side to the other causing uneven yarn. With this apron alignment and contact throughout the draft zone, quality yarn is facilitated. A distance "R" between an upper concave groove surface 24 and a lower concave groove surface 26 is prescribed by the type fibers being drafted between the aprons.

Figure 5:
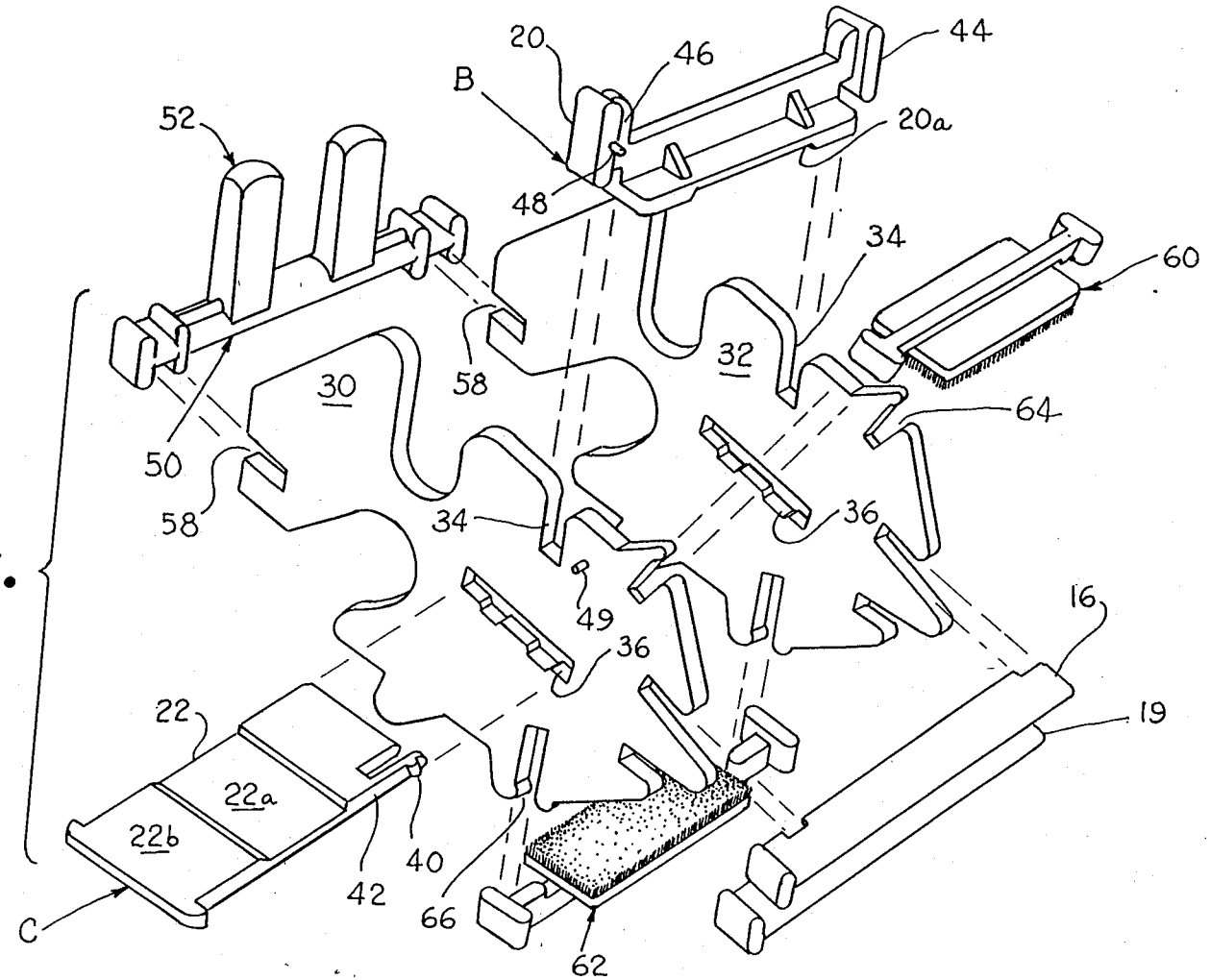
FIG. 5 is an exploded view illustrating an improved drafting apron cradle constructed according to the present invention with the top and bottom rolls and upper and lower aprons omitted for clarity.

As can best be seen in FIG. 5, the mounting means includes spaced side plates 30, 32 between which the upper and lower aprons are carried. Control plate slots 34, 36 formed in the side plates in which upper and lower fiber control plates 20, 22 are carried. Means releasably retaining the control plates in the control plate slots is provided for releasing the control plates for exchange of control plates having control grooves dimensioned according to the type fibers drafted and for holding said control plates in place during drafting. The release means includes a side projection 40 on a flexible finger 42 carried by control plate 22 which deflects laterally. Projection 40 catches on the outside of opposing side plate 32. Upper control plate 20 includes tabs 44 on arms 46 which are toleranced to fit in grooves 34. A side projection 48 on tabs 44 latches with a pin 49 carried on the side plates. Top run 10*b* of belt 10 also holds plate 20 .

A cradle shelf 50 extends between side plates 30, 32 which includes a one-piece sliver guide 52 for guiding slivers of fibers through drafting aprons 10, 12. Shelf attachment means 54 is provided for releasably attaching the shelf and guide to the side plates so that the shelf automatically detaches from the side plates in the event sliver accumulates between a nip 56 of top and bottom rolls 14, 18 and said sliver guide 52. Shelf attachment means 54 includes cradle shelf slots 58 formed in the side plates which are open ended towards sliver guide 52 and release shelf 50 rearwardly. Fiber clearer means 60, 62 are carried in fiber clearing contact with upper apron 10 near upper apron guide means 16 and with lower apron 12 near said lower apron guide means 19. Clearer fastening means in the form of slots 64, 66 are provided for releasably attaching the respective clearer means to the mounting means.

Figure 4:
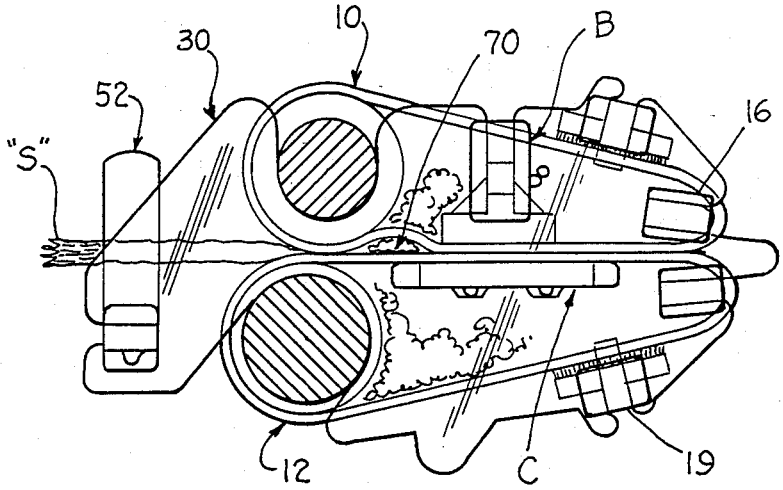
FIG. 4 is a side view of an improved drafting apron cradle constructed according to the invention having transparent properties for fiber build-up and other fiber irregularity detection.

As can best be seen in FIG. 4, the improvement further includes in combination with a one-piece apron drafting cradle having a pair of spaced side plates 30, 32, and upper and lower drafting aprons 10, 12 arranged in a fiber transport relation for delivering fibers between the aprons during drafting, a window means D formed on side plates 30, 32 for visible inspection of first runs 10*a*, 12*a* of the upper and lower aprons and detection of unwanted fiber accumulations between the upper and lower aprons 10, 12 between the side plates. The fiber control means B, C defines a range in which first runs 10*a*, 12*a* of the aprons are allowed to deflect. The fiber control means limits the deflection beyond this range to exert positive control over the sliver of fibers being drafted while permitting passage of large tufts and the like. Adverse sliver drafting conditions, i.e. fiber laps, apron misalignments, and accumulation of undesirable fibers 70 between the aprons in this area can be detected through window means D. Inspection and detection of undesirable operation and conditions can save parts breakage, sliver defects, and provide many other advantages, including decreased down time and increased efficiency. In a preferred embodiment, the window means is provided by constructing the entire side plates out of clear polyester or other transparent, see-through material.

While a preferred embodiment of the invention has been described using specific terms, such description is for illustrative purposes only, and it is to be understood that changes and variations may be made without departing from the spirit or scope of the following claims.

What is claimed is:

1. An apron drafting system for drafting a textile sliver and the like comprising:

an upper apron and a lower apron between which said silver is drafted;

mounting means for mounting said upper apron generally above said lower apron and for rotating said upper and lower aprons to cause drafting of said sliver in a first direction;

said upper apron having a first run and a second run between a top roll and a top apron guide about which said upper apron travels, said lower apron having a first run and a second run between a bottom roll and a bottom apron guide about which said bottom apron travels, said first run of said upper apron and said first run of said lower apron coextending generally face to face in a fiber delivery contact relation; and fiber control means disposed adjacent said first run of said upper apron and said first run of said lower apron for controlling the amount of deflection of said aprons in a direction generally normal to said first runs to allow said aprons to deflect by a first amount within a prescribed range and limiting apron deflection beyond said prescribed range to allow passage of large slubs and the like and to maintain positive control over said sliver drafted.

2. The apparatus of claim 1 wherein said fiber control means includes an upper fiber control plate carried near said first run of said upper apron and a lower fiber control plate carried near said first run of said lower apron, and said upper and lower fiber control plates being arranged between the respective first and second runs of said aprons.

3. The apparatus of claim 2 wherein said upper and lower fiber control plates are arranged immediately adjacent said respective first runs of said upper and lower aprons, and said fiber control means includes an upper concave groove formed in said upper control plate and a lower concave groove formed in said lower control plate, said first runs of said upper and lower aprons deflecting into said upper and lower concave grooves respectively, and said upper and lower control plates including apron guide ledges defined on opposing sides of said upper and lower concave grooves for guiding and supporting said aprons.

4. The apparatus of claim 3 wherein said concave grooves are formed generally centrally in said control plates to confine said sliver centrally of said aprons during passage between said aprons.

5. The apparatus of claim 3 wherein said upper and lower concave grooves include bottom surfaces with a distance between the upper concave groove surface and said lower concave groove surface being prescribed by the type fibers being drafted between said aprons.

6. The apparatus of claim 2 wherein said mounting means includes spaced side plates between which said upper and lower aprons are carried, control plate slots formed in said side plates in which said upper and lower fiber control plates are carried, and release means releasably retaining said control plates in said control plate slots for releasing said control plates for exchange of control plates having control grooves dimensioned according to the type fibers drafted and holding said control plates in place during drafting.

7. The apparatus of claim 1 wherein said mounting means includes spaced side plates between which said upper and lower aprons are carried, a cradle shelf extending between said side plates which includes an one-piece sliver guide for guiding a sliver of fibers through said drafting aprons, and shelf attachment means for releasably attaching said shelf and guide to said side plates so that said shelf automatically detaches from said side plates in the event said sliver accumulates between a nip of said top and bottom roll and said silver guide.

8. The apparatus of claim 7 wherein said attachment means includes cradle shelf slots formed in said side plates.

9. The apparatus of claim 1 including fiber clearer means carried in fiber clearing contact with said upper apron near said upper apron guide means and with said lower apron near said lower apron guide means.

10. The apparatus of claim 9 including clearer fastening means for releasably attaching said clearer means to said mounting means.

11. In an apron drafting system the improvement comprising in combination: an integral apron drafting cradle having a pair of spaced side plates, an upper drafting apron and a lower drafting apron carried by said side plates, a top roll and an upper apron guide about which said upper apron travel in respective first and second runs, a bottom roll and a lower apron guide about which said lower apron travels in respective first and second runs, said first runs of said upper and lower aprons being arranged in a fiber transport relation for delivering said fibers between said aprons during drafting, and window means formed by said side plates for visible inspection of said first runs of said upper and lower aprons and detection of unwanted fiber accumulations between said upper and lower aprons between said side plates.

12. The apparatus of claim 11 including fiber control means carried near said first runs of said upper and lower aprons for limiting a deflection of said aprons in a direction generally normal to said first runs, said fiber control means defining a range in which said first runs of said aprons are allowed to deflect, and said fiber control means limiting said deflection beyond said range to exert positive control of said sliver of fibers being drafted while permitting passage of large tufts and the like.

13. The apparatus of claim 11 including an upper fiber control plate interposed between said first and second runs of said upper apron, said upper fiber control plate being carried near said first run to limit the deflection of said first run in a direction generally normal to said first run.

14. The apparatus of claim 11 including a lower fiber control plate interposed between said first and second runs of said lower apron, said lower fiber control plate being carried near said first run to limit the deflection of said first run in a direction generally normal to said first run.

15. The apparatus of claim 14 including an upper fiber control plate interposed between said first and second runs of said upper apron, said upper fiber control plate being carried near said first run to limit the deflection of said first run in a direction generally normal to said first run.

16. The apparatus of claim 15 wherein said upper and lower fiber control plates include a fiber control groove extending through a width of said plates in the direction of sliver travel for controlling the deflection of said upper and lower aprons, said groove having a depth which allows said aprons to deflect within a prescribed range and which limits said deflection beyond said range.

17. The apparatus of claim 16 wherein said upper and lower fiber control plates include apron contacting and guiding ledges formed on either side of said grooves for supporting and guiding marginal edges of said upper and lower aprons as a medial portion of said aprons deflects into said grooves to maintain control over said sliver while accommodating passage of large tufts and the like.

18. The apparatus of claim 11 including a lower fiber control plate interposed between said first and second runs of said lower apron, said lower fiber control plate being carried near said first run to limit the deflection of said first run in a direction generally normal to said first run; and a fiber control groove extending through a width of said plate in the direction of sliver travel for controlling the deflection of said lower apron, said groove having a depth which allows said apron to deflect within a prescribed range and which limits said deflection beyond said range.

19. In an apron drafting system the improvement comprising in combination: an integral apron drafting cradle having a pair of spaced side plates, an upper drafting apron and a lower drafting apron carried by said side plates, a top roll and an upper apron guide about which said upper apron travel in respective first and second runs, a bottom roll and a lower apron guide about which said lower apron travels in respective first and second runs, said first runs of said upper and lower aprons being arranged in a fiber transport relation for delivering said fibers between said aprons during drafting, a cradle shelf extending between said side plates which includes an one-piece sliver guide for guiding a sliver of fibers through said drafting aprons, and shelf attachment means for releasably attaching said shelf and guide to said side plates so that said shelf automatically detaches from said side plates in the event said sliver accumulates between a nip of said top and bottom roll and said silver guide.

20. The apparatus of claim 19 wherein said attachment means includes cradle shelf slots formed in said side plates.

21. The apparatus of claim 20 including fiber clearer means carried in fiber clearing contact with said upper apron near said upper apron guide means and with said lower apron near said lower apron guide means.

* * * * *